United States Patent [19]

Chugh et al.

[11] Patent Number: 4,946,315

[45] Date of Patent: Aug. 7, 1990

[54] MINE ROOF SYSTEM

[76] Inventors: Yoginder P. Chugh, 1618 Tina Dr., Muphysboro, Ill. 62966; John R. Alongi, 350 E. Main, DuQuoin, Ill. 62832; Joey Linton, R.R. #4, Box 162, West Frankfort, Ill. 62896

[21] Appl. No.: 283,601

[22] Filed: Dec. 13, 1988

[51] Int. Cl.[5] ..... E21D 21/00

[52] U.S. Cl. ..... 405/288; 405/259

[58] Field of Search ..... 405/259, 260, 261, 288, 405/132, 291; 299/11

[56] References Cited

U.S. PATENT DOCUMENTS

| | | | |
|---|---|---|---|
| 715,406 | 12/1902 | Meem | 405/288 |
| 819,361 | 5/1906 | Meem | 405/288 |
| 3,991,577 | 11/1976 | Thevenoux | 405/291 |
| 4,073,151 | 2/1978 | Harmsma | 405/291 |
| 4,274,762 | 6/1981 | Johnson | 405/259 |
| 4,349,300 | 9/1982 | Kelley | 405/288 |
| 4,456,405 | 6/1984 | Galis | 405/288 |
| 4,601,616 | 7/1968 | Barish et al. | 405/288 |

OTHER PUBLICATIONS

Mangelsdorf, Current Trends in Roof Truss Hardware, Jul. 19–21, 1982, Second Conference on Ground Control in Mining.

Western Support Systems, Big Ben II Truss Bolt, Sep. 11, 1986.

Pattin Manufacturing, Roof Support Using Pattin Truss as Primary or Supplemental Support, Dec. 9, 1982.

James J. Scott and Brian R. Castle, A New Combination: Friction Suspension Support System Scott Cable Slings.

F. M. Locotos Co., Inc.; Double Bolt Truss.

*Primary Examiner*—David H. Corbin

*Attorney, Agent, or Firm*—Ronald W. Hind

[57] ABSTRACT

Apparatus (1) for supporting a mine roof (R) has connected plates (7, 9) positioned against the roof at opposite sides of the mine roof. One plate (7) has an upset surface (13) contacting the roof to exert a compressive load on it. Bolts (53) anchor the plates to the roof. A tie rod (64) interconnects the plates and is adjustable to vary the compressive load, and in one embodiment a slip anchor (67) is provided at one end of the tie rod which can also be utilized to estimate the tie rod load.

18 Claims, 3 Drawing Sheets

MINE ROOF SYSTEM

BACKGROUND OF THE INVENTION

This invention relates to roof support systems and, more particularly, to a roof support apparatus for a mine.

Roof trusses or roof support systems for mines, although a fairly recent innovation, are now commonly used in, for example, coal mines to provide support to the immediate roof strata. A typical roof truss system utilizes a tie rod or truss member placed parallel to the roof of the mine, and a roof bolt angled into the mine roof at each end of the member. The truss member is placed in tension to create stresses in the immediate roof area; these stresses being compressive stresses exerted in both the vertical and horizontal directions. One such system is described in U.S. Pat. No. 4,601,616 (Barisha et al) which discloses the use of single connector plates between the inclined anchor rods and a compound tie rod which utilizes turnbuckle-like coupling sleeves.

While the roof truss support systems are generally useful, present systems do have some shortcomings. Among these are a failure to physically apply upward thrust to the immediate roof strata away from the angle bolts; truss systems must be installed outside of normal production cycle because of long installation time required; the truss systems are not capable of controlled yielding as ground movements occur; and, there is no load measuring device for reading the load acting on the system at any one time.

The present apparatus solves these and other problems in a manner not disclosed in the known prior art.

SUMMARY OF THE INVENTION

Among the several objects of the present invention may be noted the provision of apparatus for supporting a roof and exerting a compressive load thereon; the provision of such apparatus which is quickly and easily installed in a mine; the provision of such apparatus which applies a compressive load to the immediate roof strata after installation; the provision of such apparatus in which the tension to which the system is subjected can be adjusted; the provision of such apparatus in which the load to which the system is subjected is readily ascertainable; and, the provision of such apparatus which is capable of controlled yielding if ground movement occurs.

It is an aspect of this invention to provide first and second connection means positionable against a mine roof at opposite sides thereof adjacent the opposing pillars, each connection means having an upset surface contacting the mine roof for exerting a compressive load on the roof; means for anchoring the connection means to the roof; and tie means interconnecting the first and second connection means, the tie means being adjustable to vary the compressive load exerted on the mine roof by the connection means and said connection means upset surface being offset from said tie means.

It is another aspect of this invention to provide that each connection means comprises a connector plate and a truss plate and means interconnecting said plates.

It is yet another aspect of this invention to provide that each connector plate has an upper section and a lower section and side reinforcing sections, the connector plate upper section having a concave surface providing said upset surface the outer portion of which bears against the roof of the mine.

It is still another aspect of this invention to provide that the means connecting the connector plate to the truss plate include pin means to simplify the connection between said plates and another aspect to provide that the lower section of each connector plate has a pair of spaced apart keyhole slots and each truss plate has a pair of openings and said pin means includes pins received in the slots to connect the plates together.

Yet another aspect of this invention is to provide that the anchor means includes a pair of bolts, each bolt being set into the roof at an angle.

Still another aspect of this invention is to provide that the tie means comprises a tie rod interconnecting the connector plates.

It is an aspect of this invention to provide means permitting slippage of the apparatus if loads on the apparatus become excessive, and another aspect to provide that the slippage means includes a hollow non-rotating cylinder attachable to said connector plate, the slippage means further includes a tapered plug having a longitudinal bore to receiving the tie rod, the cylinder having a tapered inner diameter to accomodate the plug, the taper angle of the plug and the inside of the cylinder providing suitable load deformation characteristics for the apparatus.

It is another aspect of the invention to provide means for indicating the amount of tension on the tie rod, and another aspect to provide that the cylinder has a longitudinal elongate slot in the side thereof with markings on the outside of slot to indicate different levels of tension and to provide that the plug has a circumferential marking on its outer face which is visible through the slot as the position of the plug moves relative to the slot.

Yet another aspect of this invention is to provide intermediate anchor means and coupling means, attached to said roof by said intermediate anchor means and cooperating with said tie means to connect said anchor means to said intermediate anchor means, and another aspect to provide that the intermediate anchor means is a vertical bolt and the coupler is U-shaped.

It is an aspect of this invention to provide a mine roof support apparatus which is relatively inexpensive, easy to install and effective in operation.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
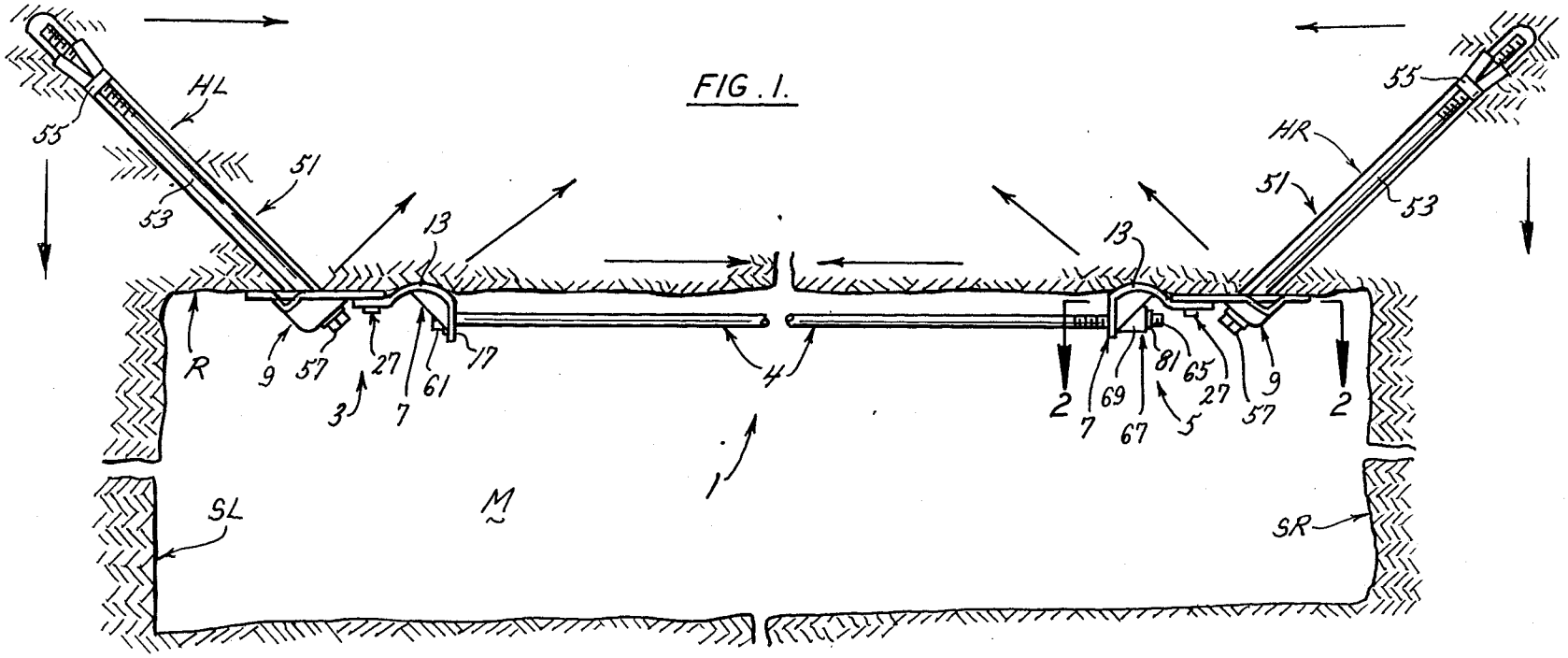
FIG. 1 is an elevational view of a mine opening with apparatus of the present invention installed.

Referring now by reference numerals to the drawings and first to FIG. 1, it will be understood that the mine opening M is defined by a roof R and opposed side pillars SL and SR. Apparatus to support roof R and for exerting a compressive load thereon is indicated generally by numeral 1.

Apparatus 1 includes a first connection means 3 and second connection means 5 which are positionable against opposite sides of roof R adjacent respective side pillars SL and SR and act in conjunction with inclined anchor means provided adjacent each of said side pillars. The connection means 3 and 5 are interconnected by a truss tie rod 4 for the purpose of inducing compression and thrust forces into the mine roof as indicated by arrows. Since the connection means at both ends are substantially identical except for the ends of the truss rod, the connection means will be described with reference to connection means 5.

Figure 10:
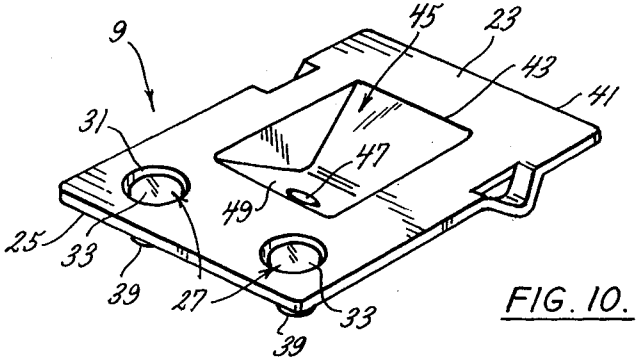
FIG. 10 is a perspective view of a truss plate of the apparatus.
Figure 9:
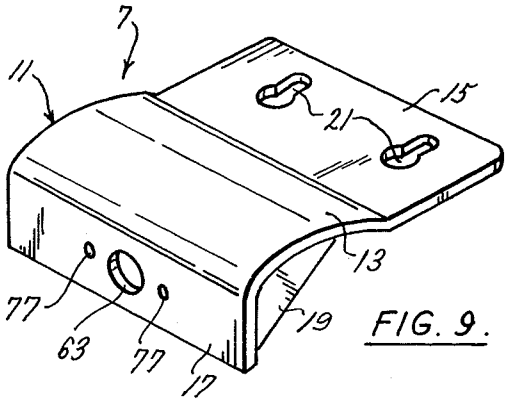
FIG. 9 is a perspective view of a connector plate of the apparatus.

As shown in FIGS. 9 and 10, connection means 5 includes a connector plate 7 and a truss plate 9. Connector plate 7 has an upper section 11 which is concave in cross-section so the section has a contoured or upset surface 13. When apparatus 1 is installed, surface 13 bears against roof R to impart a compressive force against the immediately adjacent roof strata by virtue of the line of action of the tie rod 4 being offset from the plane of the truss plate 9. One end of the concave section 11 transitions into a flat lower section 15 while the other end of the section adjoins a front, vertical section 17. A pair of reinforcement plates 19, one on each side, connect diagonally between sections 13 and 17 and act as reinforcement for the curved section 11. Section 15 has two spaced apart, parallel, keyhole shaped slots 21 which are parallel to the longitudinal axis of plate 7. Slots 21 are used to connect plates 7 and 9 and the wider end of each slot is adjacent the rear face of concave section 11.

Figures 2, 3, 4, 5, 6, 7:
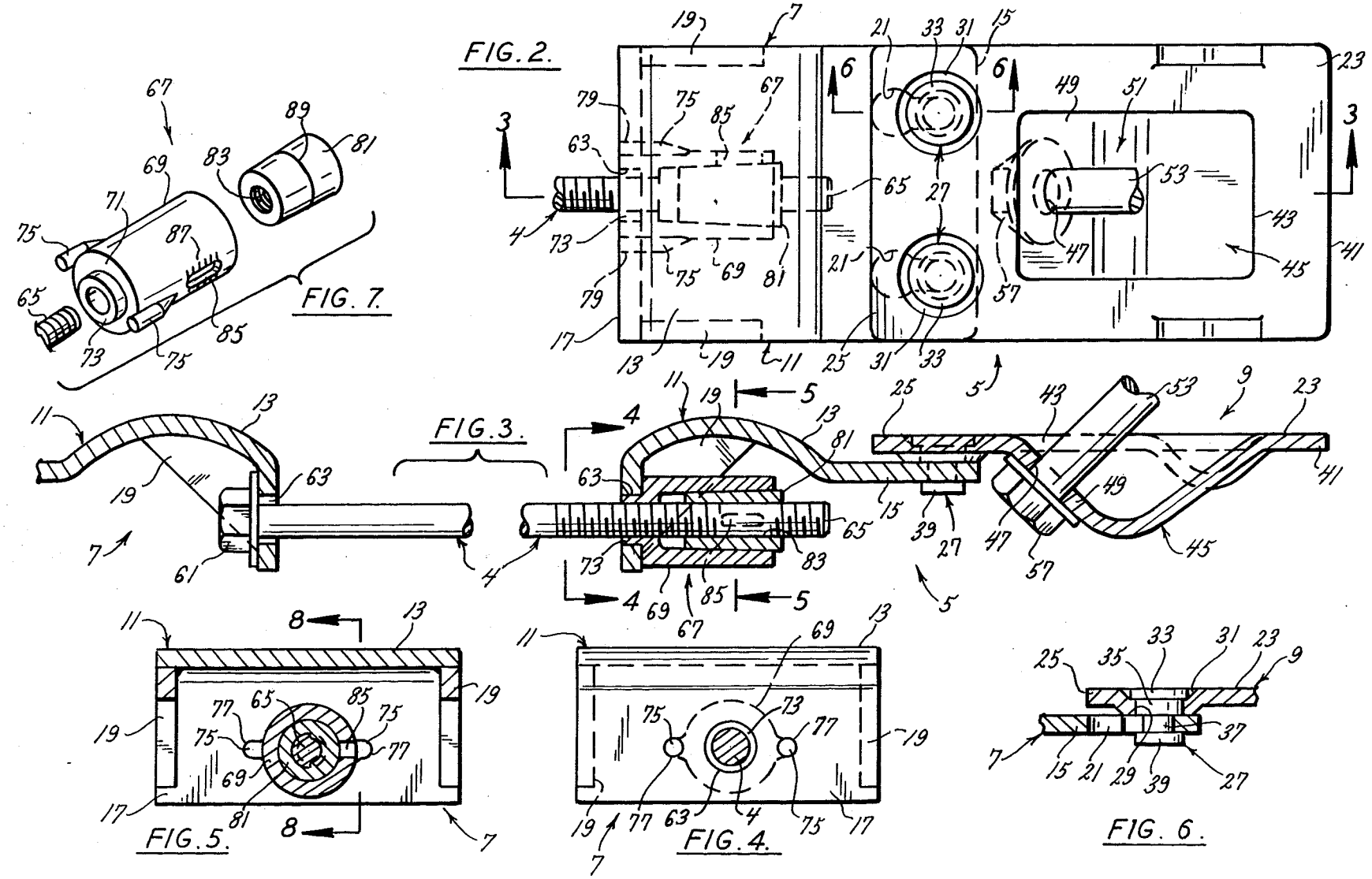
FIG. 2 is a sectional view taken along line 2—2 in FIG. 1.
FIG. 3 is a sectional view taken along line 3—3 in FIG. 2.
FIGS. 4 and 5 are sectional views taken along lines 4—4 and 5—5, respectively, in FIG. 3.
FIG. 6 is a sectional view taken along line 6—6 in FIG. 2.
FIG. 7 is an exploded view of a slip mechanism of the apparatus.

Truss plate 9 has a flat upper surface 23 which bears against roof R. The truss plate 9 has a forward section 25, which overlays section 15 of connector plate 7. As best shown in FIGS. 3 and 6 a pair of quick disconnect pins 27 are secured to section 25 and depend from the underside of this section. Pins 27, which are received in slots 21, fit through openings 29 formed in the truss plate 9. During manufacture of the truss plate, a pair of circular recesses 31 are formed in the plate, as, for example, by punching; and, openings 29 are formed in the base of each recess for the pins to be inserted. The pins 27 have base 33 whose diameter is greater than that of opening 29, a shaft 35 of the same diameter as the opening 29, a head 39 of the same diameter of the shaft and the enlarged portion of the keyhole slot 21 of the connector plate 7 and an intermediate, smaller diameter section 37 which is slightly smaller than the smaller width of the keyhole slot 21. This arrangement provides that when plates 7 and 9 are connected (see FIGS. 2, 3 and 6), the reduced diameter section of pins 27 is fitted in the smaller width portion of slots 21 thereby holding the connector plate 7 and the truss plate 9 together against movement away from each other.

Plate 9 has a rearward section 41 in which is formed a recess 43 having a rectangular opening; also, for example, by stamping. Forming of recess 43 creates an attaching section 45 for attaching the truss plate 9 to the mine roof. Section 45 is triangular in cross-section and depends from the underside of the plate. An opening 47 is formed in the forward face 49 of section 45.

Apparatus 1 includes anchor means 51 for anchoring truss plate 9 plate to roof R. As shown in FIG. 1, holes HL and HR are drilled diagonally upwardly and outwardly in roof R and anchor means 51 includes bolts 53 which are inserted into these holes. In operation, both sets of plates 7 and 9 are connected together as previously described. The shaft of each bolt 53 is inserted through opening 47 in each plate 9 and an expansion nut 55 is installed on the threaded end of each bolt. The bolt is then inserted into hole HL or HR and the head 57 of the bolt is turned with a wrench or pneumatic tool until the nut expands to secure the bolt in the hole.

The tie rod 4 is connected between opposed connector plates 7 of each of the connection means 3 and 5 and to this end section 17 of each plate 7 has a centrally located bore 63 sized to receive the rod 4 which includes a bolt head 61 and a threaded end 65. Tie rod 4 is of an appropriate length so the rod can be loosely installed between plates 7 prior to the installation of connection means 3 and 5 to the roof of the mine as above described. Once the connection means 7 and 9 are installed, a nut (not shown) can be provided on the threaded end of the tie rod 4 and tightened until the appropriate loading is attained. Alternatively and preferably, as will now be described, a slip anchor 67 can be provided.

Figure 8:
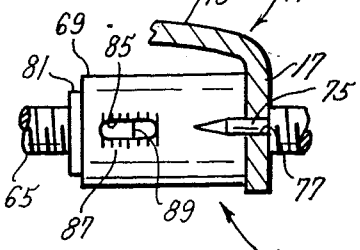
FIG. 8 is a sectional view taken along line 8—8 in FIG. 5.

The provision of the slip anchor 67 permits slippage of the apparatus if the load on the apparatus becomes excessive. The slip anchor 67, as best shown in FIGS. 7 and 8 comprises a hollow cylinder 69 attachable to the inside of section 17 of connection plate 7. Cylinder 69 has a base 71 which abuts the inner face of section 17 of connector plate 7 of connection means 5. A shoulder 73 extending longitudinally outwardly from the base has an outer diameter sized to fit in opening 63. The shoulder is bored to a diameter allowing the threaded end 65 of tie rod 4 to fit through the shoulder. On the periphery of base 71, and diametrically opposed to each other are a pair of pins 75 attached to said base, as by welding. Section 17 of connector plate 7 has a pair of openings 77 of the same diameter as the pins 75. Openings 77 have the same spacing with respect to the centerline of opening 63 as pins 75 which fit through opening 77 to hold cylinder 69 in place and prevent its rotation during adjustment of tie rod 4.

As shown in FIGS. 3, 7 and 8, cylinder 69 has a tapered inner wall and a tapered plug 81 is received in the opposite end of the cylinder from base 71. Plug 81 has a longitudinal threaded bore 83 in which is received threaded end 65 of tie rod 4. When the apparatus is installed, the loading on the apparatus can be adjusted by the degree to which plug 81 is drawn into cylinder 69 by turning tie rod 4 the appropriate direction.

Cylinder 69 also has an elongate slot 85 in its sidewall, the slot being parallel to the longitudinal axis of the cylinder. Calibration marks 87 are inscribed on the side wall of the cylinder adjacent slots 85, and plug 81 has a circumferential inscribed line 89 which can be seen through the slot as shown in FIG. 8. It will be understood that the taper angle of plug 81 can be selected to suit the load deformation characteristics of the apparatus. The calibration markings on cylinder 69 and plug 81 allow a ready determination of the tension level to which the apparatus is adjusted upon installation. In addition, the taper angle of the plug permits slippage of the apparatus if excessive ground loads occur. Thus the apparatus tends to yield to these variations without an abrupt collapse of the apparatus.

Figure 11:
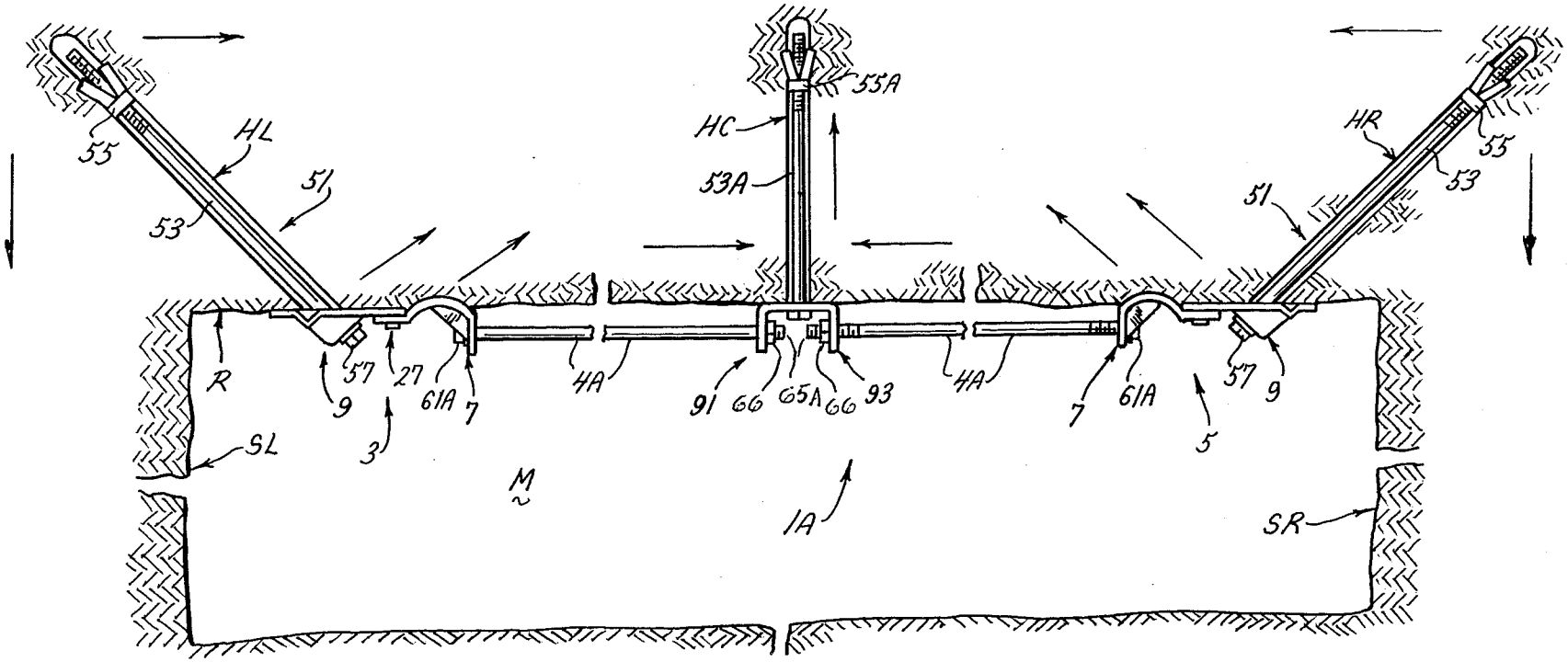
FIG. 11 is a plan view similar to FIG. 1 but showing an alternate embodiment of the apparatus.
Figure 12:
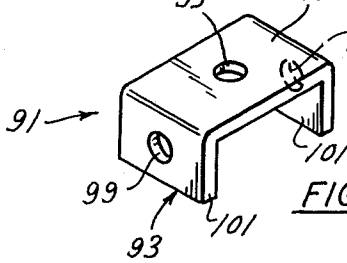
FIG. 12 is a perspective view of a coupler used in the alternate embodiment.

Referring to FIG. 11, there is disclosed an embodiment of the apparatus 1A similar to that previously described but which includes an intermediate coupling means 91 for a pair of tie rods 4A. Coupling means 91 comprising a U-shaped coupler 93 which is positioned at the mid-point of roof R intermediate plate means 3 and 5. Coupler 93 is installed in an inverted position by an anchor bolt 53A set in a center hole HC which is vertically drilled into the roof. As shown in FIG. 12, the coupler 93 has an opening 95 in its base 97 to accomodate bolt 53A and it is intended that the coupler be fixedly attached to the roof R by said bolt 53A which, except for its vertical disposition, can be identical to inclined anchor bolts 53 and constitutes intermediate anchor means. The coupler also has openings 99 in each arm 101 for connecting associated tie rods 4A between the coupler and the connector plate 7 of the respective plate means 3 and 5. In this modified apparatus each tie rod 4A includes a bolt head 61A and a threaded end 65A. The threaded ends 65 can be provided with regular nuts 66 or with slip anchors 67. In effect, because of the fixed nature of coupler 93, each tie rod 4A cooperates with an inclined anchor bolt 53 and the anchor bolt 53A to provide a pair of independent systems rather than the single system previously described.

Figure 13:
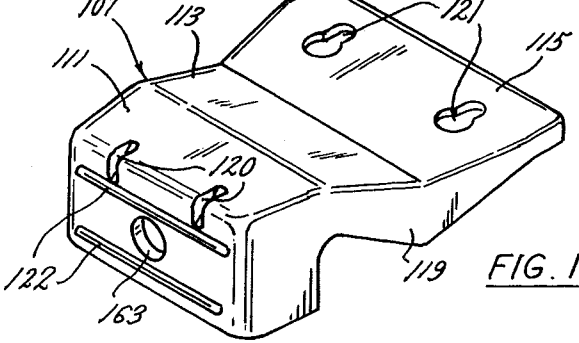
FIG. 13 is a perspective view of a modified connector plate.

FIG. 13 discloses a modified connector plate 107 which fulfills the same purpose as connector plate 7 described above. Connector plate 107 is generally tapered to be narrower at the tie rod end and has an upper section 111 which is similarly offset from the axis of the tie rod axis. However, the sloping surface 113 between the flat lower section 115 and the upper section 111 tends to be straight rather than curved to produce a relatively flat offset upper section. The reinforcing plates 119 are integrally formed with sections 111, 113 and 115 and the tie rod end is reinforced by indentations at the upper 120 corner and the front face is stiffened by ribs 122. The keyhole slots 121 are substantially identical to those shown in FIG. 9.

In view of the above it will be seen that various aspects and features of the invention are achieved and other advantageous results attained While a preferred embodiment of the invention has been shown and described, it will be clear to those skilled in the art that changes and modifications may be made therein without departing from the invention in its broader aspects.

We claim as our invention:

1. In a mine having a roof and opposing side pillars, apparatus for supporting the roof and for exerting a compressive load on the roof comprising:

first and second connection means positionable against the roof at opposite sides thereof adjacent the opposing pillars, each connection means having an upset surface contacting the mine roof for exerting a compressive load on the roof;

(b) anchoring means at each side of the roof for anchoring each connection means to the roof; and (c) tie means interconnecting the first and second connection means, the tie means being adjustable to vary the compressive load exerted on the mine roof by the connection means and said connection means upset surface being offset from said tie means and spaced from the anchoring means.

2. The apparatus of claim 1 wherein: (d) each connection means comprises a truss plate, a connector plate disposed inwardly of said truss plate and means interconnecting said plates.

3. The apparatus of claim 2 wherein:

(e) the connector plate has an upper section and a lower section and side reinforcing sections, the connector plate upper section having a concave surface providing said upset surface the outer portion of which bears against the roof of the mine.

4. The apparatus of claim 3 wherein:

(f) the means connecting the connector plate to the truss plate include pin means.

5. The apparatus of claim 4 wherein:

(g) the lower section of each connector plate has a pair of spaced apart keyhole slots and each truss plate has a pair of openings and said pin means includes pins received in the slots to connect the plates together.

6. The apparatus of claim 2 wherein:

(e) each truss plate includes means for connecting the truss plate to the anchor means.

7. The apparatus of claim 6 wherein:

(f) the anchor means comprises a pair of bolts, one for anchoring each truss plate, each bolt being set into the roof at an angle.

8. The apparatus of claim 1 wherein:

(d) each connector means comprises a connector plate and the tie means comprises a tie rod interconnecting the connector plates.

9. The apparatus of claim 8 further including:

(e) means permitting slippage of the apparatus if loads on the apparatus become excessive.

10. The apparatus of claim 9 wherein:

(f) each connector plate has an opening through which an end of the tie rod can be inserted and the slippage means includes a hollow non-rotating cylinder attachable to said connector plate.

11. The apparatus of claim 10 wherein:

(g) the slippage means further includes a tapered plug having a longitudinal bore to receiving the tie rod, the cylinder having a tapered inner diameter to accomodate the plug, the taper angle of the plug and the inside of the cylinder providing suitable load deformation characteristics for the apparatus.

12. The apparatus of claim 11 further including:

(h) means for indicating the amount of tension on the tie rod.

13. The apparatus of claim 12 wherein:

(i) the cylinder has a longitudinal elongate slot in the side thereof with markings on the outside of slot to indicate different levels of tension.

14. The apparatus of claim 13 wherein:

(j) the plug has a circumferential marking on its outer face which is visible through the slot as the position of the plug moves relative to the slot.

15. The apparatus of claim 7 further including:

(g) intermediate anchor means and coupling means attached to said roof by said intermediate anchor means and cooperating with said tie means to connect said anchor means to said intermediate anchor means.

16. The apparatus of claim 15 wherein:

(h) the coupling means comprises a coupler positioned intermediate the first and second connection means and the anchor means further includes a bolt for fixedly anchoring the coupler to the roof of the mine.

17. The apparatus of claim 16 wherein:

(i) the tie means comprise first and second tie rods, the first tie rod connecting one connector plate to the coupler and the second tie rod connecting the other connector plate to the coupler.

18. The apparatus of claim 17 wherein:

(j) the coupler is U-shaped.

* * * * *

UNITED STATES PATENT AND TRADEMARK OFFICE

CERTIFICATE OF CORRECTION

PATENT NO. : 4,946,315

DATED : August 7, 1990

INVENTOR(S) : Chugh et al.

It is certified that error appears in the above-identified patent and that said Letters Patent is hereby corrected as shown below:

Column 5, line 62, before "first" add --(a)--.

Column 6, line 7, delete "(d) each connect-".

Column 6, line 8, delete "tion" and insert --(d) each connection--.

Signed and Sealed this

Fourth Day of August, 1992

*Attest:*

DOUGLAS B. COMER

*Attesting Officer*

*Acting Commissioner of Patents and Trademarks*